US007270643B2

(12) United States Patent
Pellinen

(10) Patent No.: US 7,270,643 B2
(45) Date of Patent: Sep. 18, 2007

(54) APPARATUS AND ARRANGEMENT FOR EXERCISING AND SUPPORTING AN UPPER LIMB

(75) Inventor: Ari Pellinen, Heinola (FI)

(73) Assignee: Olecranon Oy, Lahti (FI)

( * ) Notice: Subject to any disclaimer, the term of this patent is extended or adjusted under 35 U.S.C. 154(b) by 537 days.

(21) Appl. No.: 10/830,060

(22) Filed: Apr. 23, 2004

(65) Prior Publication Data

US 2004/0225244 A1 Nov. 11, 2004

Related U.S. Application Data

(63) Continuation-in-part of application No. PCT/FI02/00832, filed on Oct. 25, 2002.

(30) Foreign Application Priority Data

Oct. 25, 2001 (FI) ..... 20010398 U

(51) Int. Cl.

| | |
|---|---|
| ***A61F 5/00*** | (2006.01) |
| ***A63B 21/02*** | (2006.01) |
| *A63B 1/00* | (2006.01) |
| *A63B 22/12* | (2006.01) |
| *A63B 69/16* | (2006.01) |

(52) U.S. Cl. ..... 602/20; 602/5; 602/16; 482/112; 482/124; 482/148; 482/62; 482/67; 482/43

(58) Field of Classification Search ..... 602/5, 602/16, 18; 482/112, 113, 124, 148, 62, 482/67, 43, 78

See application file for complete search history.

(56) References Cited

U.S. PATENT DOCUMENTS

| | | | | |
|---|---|---|---|---|
| 4,588,186 A | | 5/1986 | Calabrese | |
| 4,836,195 A | | 6/1989 | Berrehail | |
| 5,487,724 A | * | 1/1996 | Schwenn | 602/20 |
| 5,769,764 A | | 6/1998 | Tilberis | |
| 5,865,714 A | | 2/1999 | Marlowe | |
| 5,916,070 A | | 6/1999 | Donohue | |

* cited by examiner

*Primary Examiner*—Patricia Bianco

*Assistant Examiner*—Tarla R. Patel

(74) *Attorney, Agent, or Firm*—Young & Thompson

(57) ABSTRACT

An apparatus for exercising and supporting an upper limb includes two support modules connected on the first side by a rigid connecting piece. Both support modules have a frame, with a support plate fixed to their upper part. An exercising part is removably attached to the support plate of the first support module. An upper arm support part is articulated in the support plate and an actuator actuates the support part relative to the support plate. The frames of the support modules can be fitted immediately underneath the shoulder joints, the other upper limb being supported on the support plate in such a way that the upper limb exerts a force on the rigid connecting piece. The first upper limb is supported on the exercising part so that the weight of the upper limb exerts a force on the rigid connecting piece, the forces being balanced by the connecting piece.

14 Claims, 5 Drawing Sheets

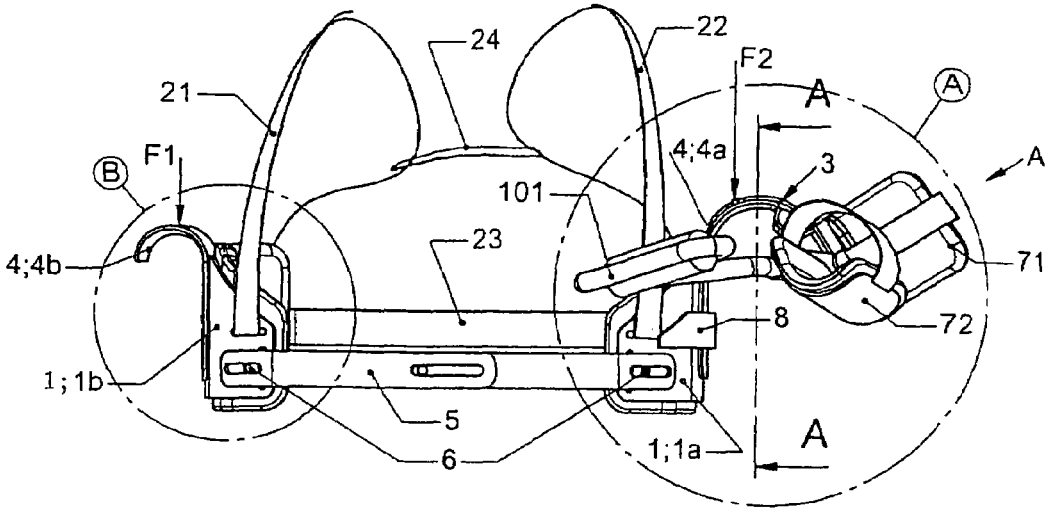
Fig. 1A
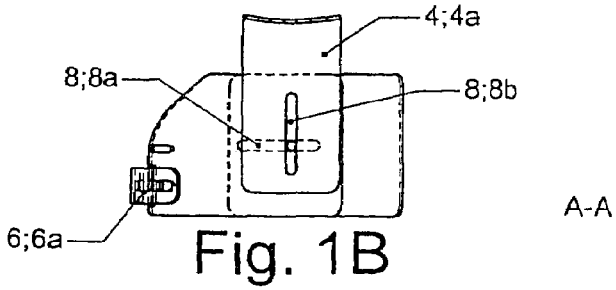
Fig. 1B
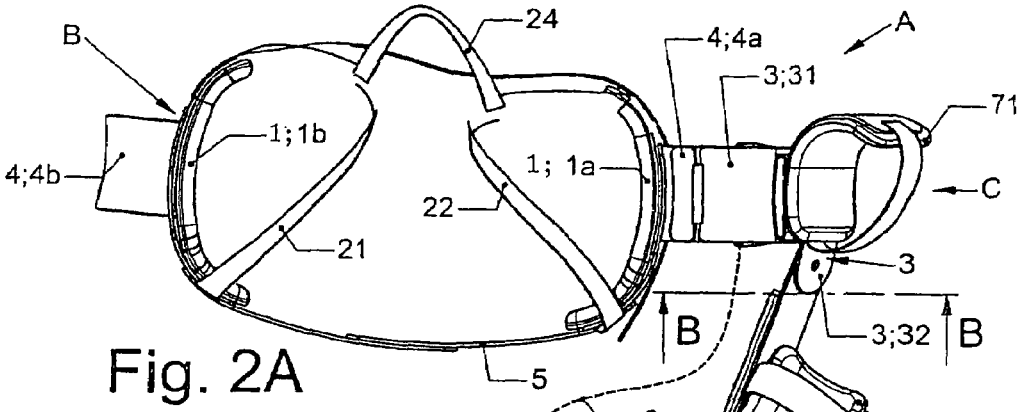
Fig. 2A
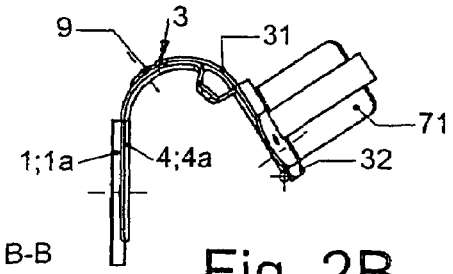
Fig. 2B
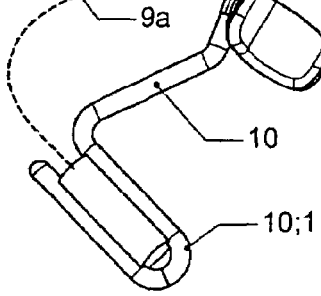

APPARATUS AND ARRANGEMENT FOR EXERCISING AND SUPPORTING AN UPPER LIMB

The invention relates to an apparatus as defined in the preamble of claim 1 and to an arrangement as defined in the preamble of claim 13 for exercising and supporting an upper limb.

The exercising and supporting apparatus of the invention is intended for supporting an upper limb (shoulder) after surgery on the shoulder and for exercising said upper limb. After shoulder surgery, the entire upper limb needs to be supported over a relatively long period of time, depending on the kind of injury. It is awkward to keep an upper limb that has undergone surgery in the same position over a long period of time, and, the upper limb may shift from the desired position especially while the patient is sleeping. Consequently, the support means should retain the upper limb in position while the patient is sleeping. Current support means usually fulfill this function, however, the patient often tends to sleep on only one side, because the means hampers the patient's body movements, making his/her life more difficult. The shoulder is rehabilitated as the patient recovers. For the time being, there are no available support apparatuses allowing the patient to efficiently rehabilitate his upper limb on his own, given the consistent risk of damage to the shoulder joint muscles moving the upper limb that have been subjected to surgery.

In this context, an upper limb subjected to surgery implies an upper limb on the side of which the shoulder joint muscles, such as, for instance, the supraspinal muscle, has been subjected to surgery.

The invention is intended to eliminate the prior art inconveniences. Thus, the first objective of the invention is to provide an apparatus allowing to efficiently prevent the movements of an upper limb that has been subjected to surgery while the patient is asleep, without disturbing or limiting the sleeping position substantially.

A second objective of the invention is to provide an apparatus allowing the patient to move the limb on the surgery side while the muscles moving the shoulder joint of this upper limb remain passive.

An additional objective of the invention is to provide an apparatus allowing the patient to start rehabilitating the upper limb on his own as soon as possible after surgery intervention.

The objectives mentioned above are achieved with the apparatus defined in claim 1 and the arrangement defined in claim 8.

The apparatus of the invention comprises two support modules (A, B) connected on the first side by a rigid connecting piece. Both the support modules have a frame to the upper part of which a support plate has been attached, with an exercising part C removably attached to the support plate of the first support module. The exercising part C comprises an upper arm support means articulated or hinged in the support plate and an actuator moving or rotating the support means or part of it relative to said support plate.

The arrangement of the invention, again, comprises an apparatus including two support modules (A, B) connected on the first side by a rigid connecting piece. Both the support modules have a rigid frame, to the upper part of which a support plate has been attached, with an exercising part C rotatable or movable attached at the joint or at the hinge means to the support plate of the first support module. The frames of the support modules (A, B) can be set immediately underneath the shoulder joints. The other healthy upper limb is supported on the support plate attached to the upper part of the frame of the support module B, with said upper limb acting on the rigid connecting piece with a force F1. The first upper limb that has undergone surgery is supported on the exercising part C attached to the support plate disposed in the upper part of the frame of the support module A, with the weight of the upper limb acting on the rigid connecting piece with a force F2. The forces F1 and F2 are balanced by the rigid connecting piece.

In a preferred embodiment, the first upper limb that has undergone surgery is supported on the support module C such that the upper arm is supported on the upper arm support means. The joint or hinge means between the upper arm support means and the support plate is set underneath the upper arm joint and the upper arm support means is moved with the actuator relative to the support plate, with the muscles in the shoulder joint and/or the upper arm that have been operated on and the muscles groups acting on these remaining substantially passive.

In a second preferred embodiment, the distance between the shoulder joint and the point of connection or the hinge means can be varied. The point of connection is formed at the joint between the upper arm support means and the support plate.

In a further preferred embodiment of the invention, movement of the upper arm support means relative to the support plate or variation of the distance between the point of connection or the hinge means and the shoulder joint simultaneously changes the length of the upper arm support means.

The basic idea of the support and exercising apparatus of the invention is that the two support modules A and B of the apparatus are fitted against the patient's sides, immediately underneath the shoulder joint. The support modules are connected by a rigid curved connecting rod on one side and by a wide band on the other side. The support module B comprises a frame, such as a metal plate, which is intended for lifting and supporting the healthy upper limb, the curvature of its inner surface corresponding roughly to the curvature of the body side. The support plate is positioned in the armpit of the healthy limb in order to lift the limb. The support module A also comprises a frame such as a metal plate, which is intended for lifting and supporting the healthy limb, the curvature of its inner surface also corresponding roughly to the curvature of the body side. The support module frames are connected by a rigid beam, which serves to transmit and balance the support forces F1 and F2 between the support modules. In this situation, with support plates fitted under each limb, the body position will be balanced. For instance, as the patient is sleeping, the apparatus has the notable advantage of efficiently preventing movement of the surgery limb, because the support modules support via the support plates the weight of the protruding upper limb at the extreme points of the frame (support means) on the back side.

The apparatus of the invention gets its support from the patient's sides, immediately underneath the shoulder joint, yielding the notable additional advantage of the protruding upper limb not exerting any pressure or torsion on the body, unlike prior art apparatuses getting their support from the hip.

The exercising part C supporting the upper limb in the apparatus of the invention comprises an upper arm support means, whose connecting piece has been articulated or hinged into a support plate attached to the frame of the module A, with the actuator of the exercising part C disposed between said connecting piece and the support plate.

The actuator is preferably pneumatically operated, and while expanding and contracting, it causes the forearm support means to move relative to the support plate. Said support means consists of a connecting piece, to which a forearm support means has been connected. The actuator of the exercising means is preferably driven by an air pump, which, in turn can be operated by the hand of the surgery limb, over a connecting hose. The actuator shifts the over-arm support means relative to the stationary support plate also in the up-down direction so that the forearm and the upper arm of the surgery upper limb move, while the muscles moving the shoulder joint (including the supraspinal muscle) and the muscle groups acting on these remain substantially passive. Such an exercising apparatus achieves the benefit of the patient being independently able to exercise and move the surgery side limb, while the surgery muscles of the shoulder joint in this upper limb or the muscle groups acting on these, still remain passive.

Since the patient may move the surgery limb on his own, rehabilitation does not necessarily call for any physiotherapist or similar aide, achieving the benefit of appreciably more rapid rehabilitation than usually. Since the patient can continually move his upper arm on his own, he moves his forearm with an appreciably regular movement. Regular and ample movement of the upper arm, again, significantly reduces the exposure of the upper arm to additional damage, because stiffening of the joint capsule due to immobility and entrapments of the shoulder nerves are prevented.

The apparatus of the invention allows independent exercise of the shoulder joint immediately upon surgery, because the lifting movement achieved with the apparatus does not move the muscles moving the shoulder joint, such as the supraspinal muscle, nor the muscle groups acting on these muscles.

The invention relates to a separate supporting arrangement for preventing and curing injuries, such as shoulder and shoulder joint injuries. The chief advantages of the supporting arrangement of the invention over current armpit supports are its reliable initial settings and adjustments, its comfort of use and its ensuring rehabilitation of the injury as promptly as possible, with the patient's active and independent intervention. Current therapeutic armpit-support means for shoulder injuries often consist of "an aeroplane-shaped" splint or shaped cushions and splints made of foam plastic. Thus, for instance, the "aeroplane-shaped splint" is the most frequently used at the initial stage of the post-surgery treatment after rotator cuff surgery, since it retains the surgery hand in position at the initial settings and adjustments better than do means made of foam plastic. When the shoulder has healed to an extent such that it is set at a smaller abduction/adduction angle, and is also allowed to move to some extent, the awkward aeroplane splint is then normally replaced with a light foam plastic splint/cushion. Yet neither of these cases takes sufficient account of the patient's comfort of use and of his/her being allowed active and independent rehabilitation. An "aeroplane splint", for instance, has fixed and basically good angular settings and adjustments, however, the splint and thus also the upper arm may turn backwards and forwards, which, in the extreme case, may hamper the healing process. This is due to the fact that the support belt is prevented from turning exclusively by its degree of tightness, and hence by the friction between the support belt and the waist, being further deteriorated by the garment layer between these two. In addition, the aeroplane splint has two joint angular adjustment, i.e. there are joints on the front and the rear side of the shoulder, so that it is difficult to use, and especially in bed, requires the use of all kinds of extra pads and cushions in order to allow the patient to rest and sleep at all. Of course, because of its fixed settings, an aeroplane splint hardly allows the patient to rehabilitate his injury on his own to any degree.

Cushions and splints made of plastic foam are certainly light and allow patients independent active rehabilitation to some extent, using palm and finger movements, for instance. However, in use, they are unfortunately impractical and awkward, because they fill up the entire armpit and are also broad in the lateral direction. This prevents the patient from dressing in the normal way, which, in turn, makes it more difficult for him/her to participate in outdoor activities and social life.

Above all, the main benefits for the patient provided by the support arrangement of the invention are solid and reliable initial settings and adjustments, the comfort of use of the device and facilities for active, independent and versatile rehabilitation. The solidity of the support system and the reliability of its settings and adjustments have been achieved by means of adjustment parts that are easy to use and can be blocked and by the connection of the two support modules not only by the tractive force but also by a connecting bar transmitting propulsive and shear forces, thus efficiently preventing the upper arm from turning. This also allows a lightening and balancing counter-force to be transmitted from the healthy armpit to the arm to be supported and treated, which, in turn, provides enhanced support reliability and comfort of use for the patient. In addition, the comfort of use of the support system has been appreciably developed compared to conventional armpit supports by keeping the patient's armpits and shoulder mainly open and free from all kinds of parts and devices, allowing the patient to dress fairly normally and to wash and rest with greater ease. In addition, the support system takes account of facilities for various pads for more comfort and independent rehabilitation movements. The patient is also allowed to rehabilitate his shoulder readily and actively on his own as promptly as possible. This has been achieved by the patient being able to personally release the blocking of the means for controlling the movements of the upper arm, the forearm and the palm, contrary to initial settings and adjustments made by the physician and the physiotherapist, so that he can do exercising movements the way he wants. In this conjunction, he may utilise e.g. one of his hands or any external actuator, such as a pump driven by hand or foot, which is connected to actuators of these movements or to depression/overpressure pads etc.

The invention is described below in further detail with reference to the accompanying drawings.

FIG. 1A is a front view of the apparatus of the invention.

FIG. 1B shows a partial cross-section of the apparatus of the figure with the apparatus viewed along line A-A in the direction defined with the arrows with a full head.

FIG. 2A is a top view of the apparatus of FIG. 1A.

FIG. 2B is a partial cross-section of the apparatus shown in FIG. 2A with the apparatus viewed along the broken line in the direction indicated by the arrows with a full head.

Figure 1C:
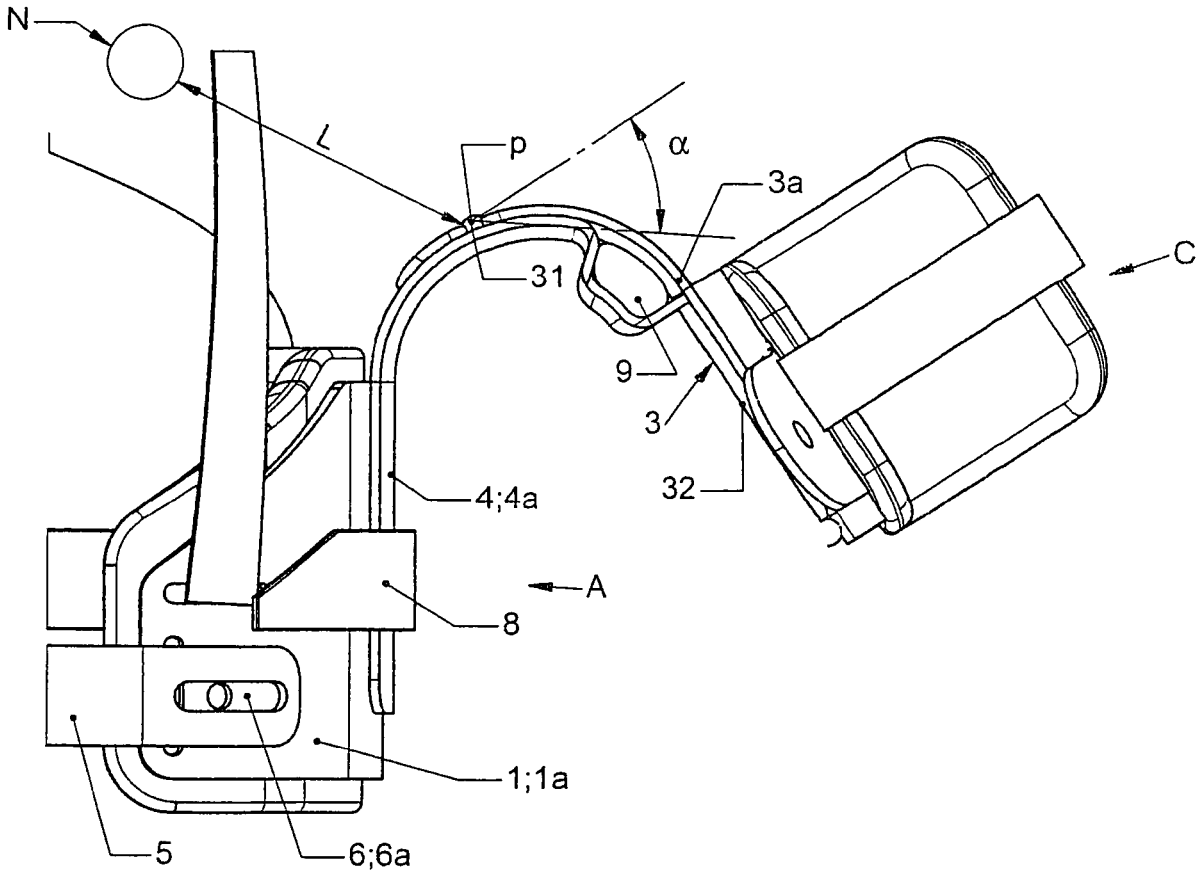
FIG. 1C illustrates the construction of the exercising part C in FIG. 1.

The following is a survey of the constructions of the figures and the specific part of the invention illustrated with each figure.

FIG. 1A illustrates the general structure of the apparatus of the invention. The apparatus comprises two support modules A and B and an exercising part C. A rigid connecting bar 5 connects the support modules A and B. Both the support modules have a frame 1, whose upper part is connected with a curved support plate 4. The exercising part C has an upper arm support means 3, which consists of a plurality of movable parts articulated into one another. In addition, the exercising part comprises an arm support means, which does not appear visibly in the figures due to the imaging angle. In fact, the arm support means appears better in FIG. 2A.

FIG. 1B shows details of the construction encircled in FIG. 1A, which firstly illustrates the connecting mode between the frame 1; 1*a* of the support module A and the rigid connecting bar 5 connected to the frame, and secondly, the connecting mode between the support plate 4; 4*a* fixed to the frame 1; 1*a* of the support module A and said frame 1*a*. The connections use various movable fixing means 6, 8, which allow variations of the mutual position between the frame 1 and the rigid connecting bar 5 on the one hand and between the frame 1 and the support plate 4 on the other hand.

FIG. 1C illustrates in still greater detail the construction of the exercising part C connected with the illustrated support module, viewed at the same angle as in figure 1A. For the sake of clarity, the elbow pad and support 27 has been omitted from exercising part C. The connecting part 31 of the support means 3 is hinged in the support plate 4; 4*a* so as to allow mutual movement of these parts in parallel with their longitudinal axis. In addition, the support means 3 comprises an upper arm support part 32 articulated in the end of the connecting part 31, this support part, in turn, consisting of two glide parts connected in gliding relationship.

FIG. 2A also illustrates the general construction of the apparatus of the invention, however, viewed from above in this case. The main structures of the figure are the same as in FIG. 1A, and the figure also shows the construction of the forearm supports means 10 of the exercising support C more visibly.

FIG. 2B illustrates the construction of the forearm support means 3 articulated in the support plate of support module A. The main components in this figure are the same as in figure 1C.

Figure 3:
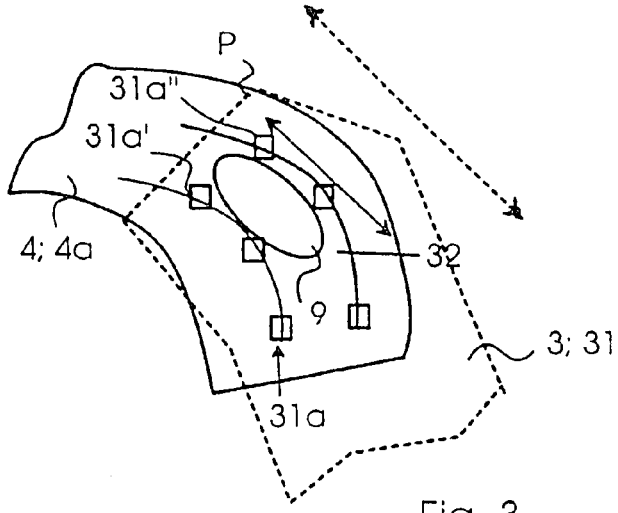
FIG. 3 is a schematic view of the construction and operation of the forearm support means of the exercising part C.

FIG. 3 illustrates the construction of the support plate 4; 4*a* of the support module A and the connecting part 32 of the upper arm support means 3 articulated into the support plate. The figure shows an actuator 9 disposed between the connecting part 32 and the support plate 4; 4*a* for variation of the angle of incidence between the connecting part 32 and the support plate.

Figure 4A:
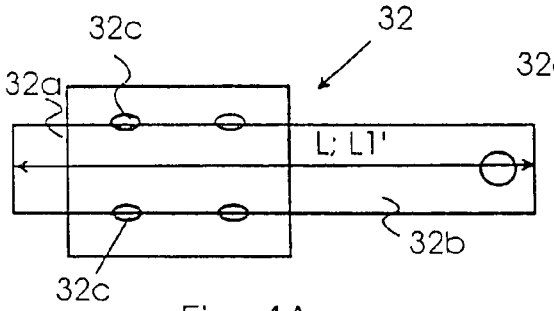
FIGS. 4A and 4B are schematic top views of the construction and operation of the forearm support means of the exercising part C.
Figure 4B:
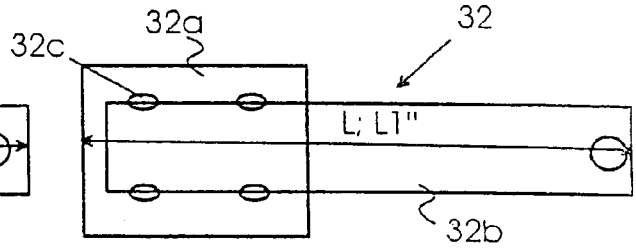

FIGS. 4A and 4B illustrate the construction of the support part 32 of the upper arm support means in greater detail. The support part 32 consists of two glide parts 32*a* and 32*b* attached in gliding relationship. The glide parts 32*a* and 32*b* glide relative to each other in the longitudinal direction of the support part, thereby altering the length L1 of the support part.

Figure 5:
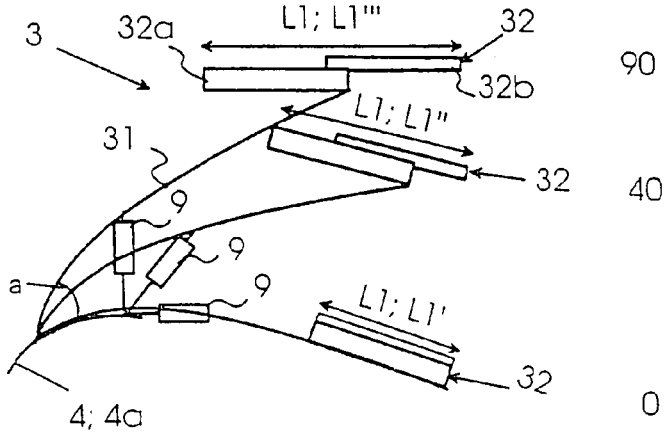
FIG. 5 is a schematic lateral view of the operation of the shoulder support part of the exercising part C, with the exercising part actuated by the actuator.

FIG. 5 is a schematic view of the change in the length L1 of the upper arm support part 32 articulated in the support plate 4; 4*a* of the support module A, which is brought about by a change in the angle of incidence between the connecting part 31 of the upper arm support means 3 and said support plate 4; 4*a* by means of the actuator 9.

Figure 6A:
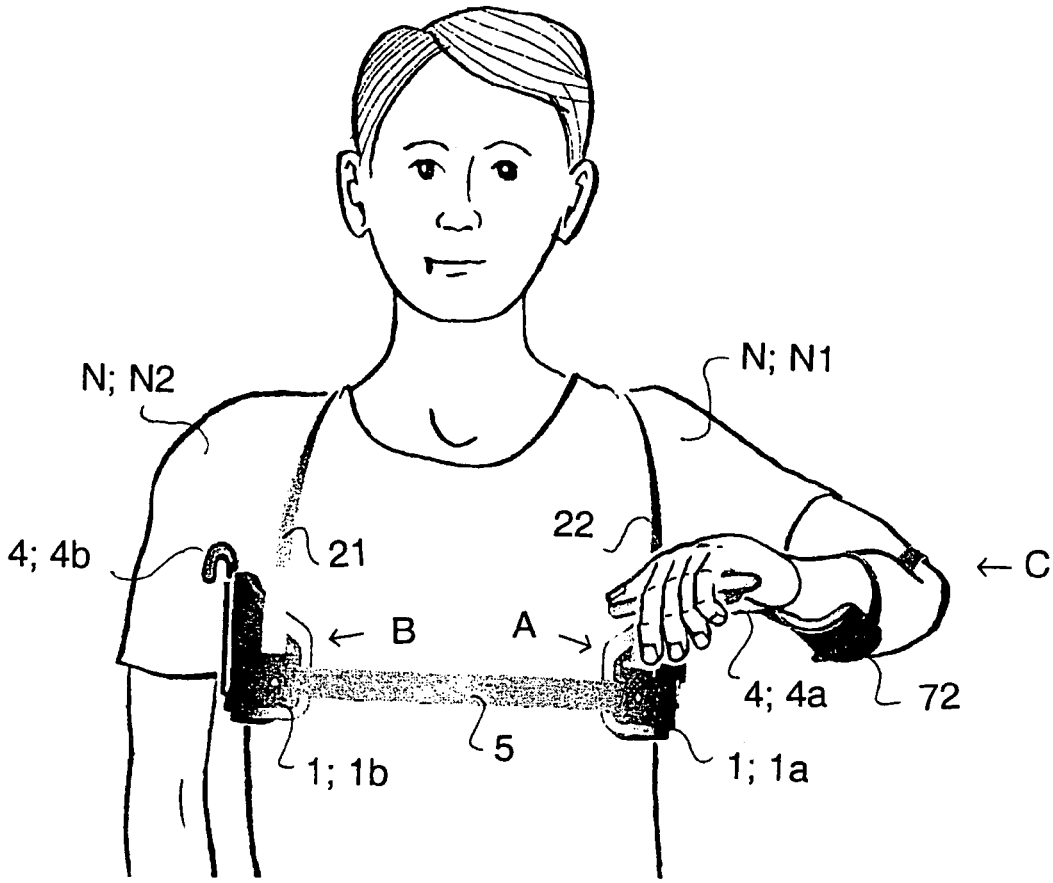
FIGS. 6A and 6B show the apparatus of the invention fitted on the patient.
Figure 6B:
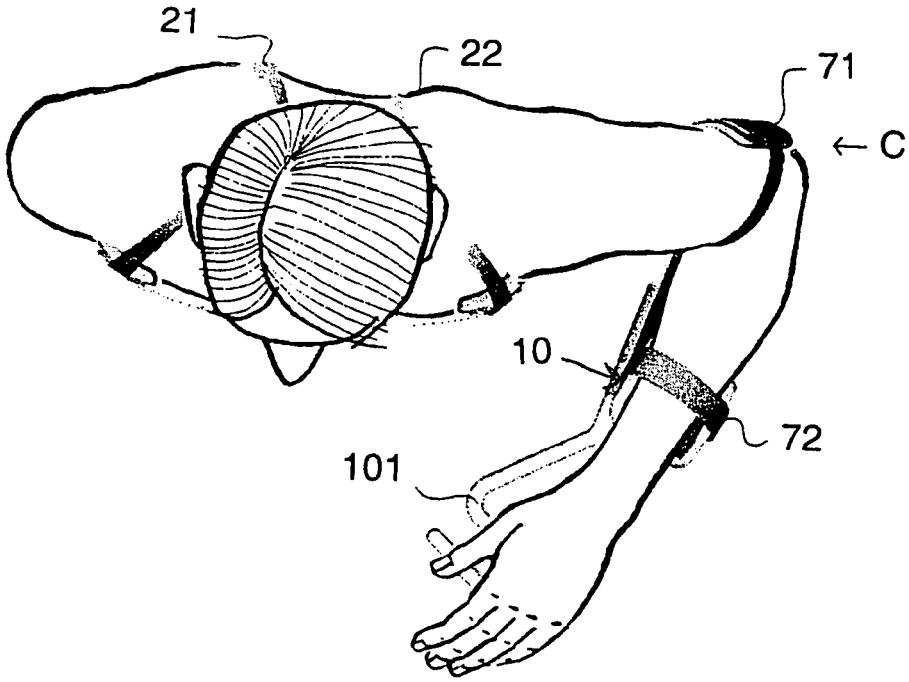

FIGS. 6A and 6B show the apparatus of the invention when worn in operating position by a patient. The support modules A and B of the apparatus are fitted immediately underneath the shoulder joint N. The support element 1; 1*b* acting as the frame of the module is located underneath the healthy shoulder joint N; N2, as shown in FIG. 6A, and module A is intended for similar attachment underneath the patient's upper limb that has undergone surgery, with the support element 1; 1*a* acting as the frame of this module located immediately underneath the shoulder joint N; N1 that has been operated on.

Figure 7:
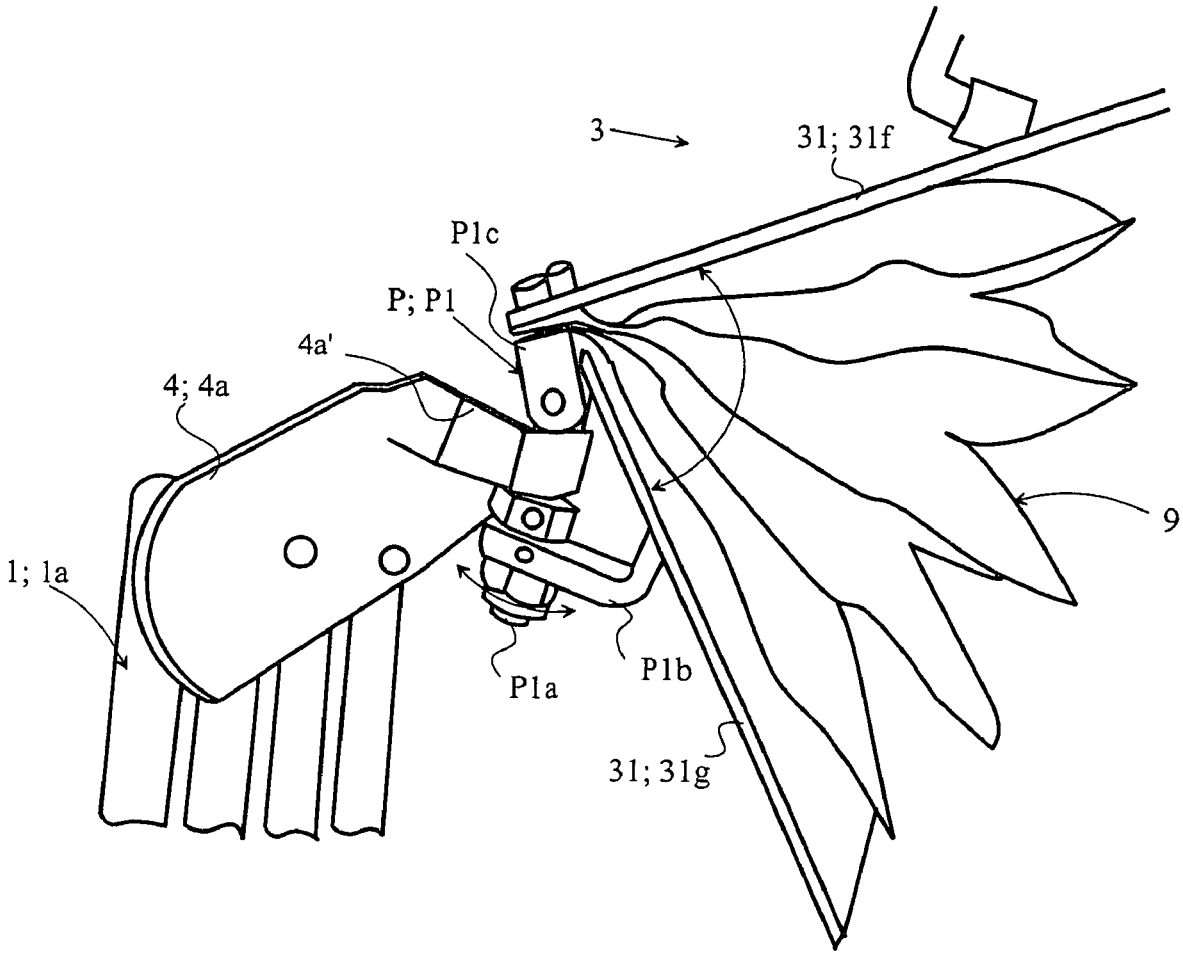
FIG. 7 shows an alternative construction of the exercising part C.

FIG. 7 illustrates an alternative construction for an exercising part C. Support means comprises several connecting parts but only the first connecting part 31 has been shown for the sake of clarity. Partially shown support element 1; 1*a* includes now several mutually connected rigid strips. On the upper part of the support element 1*a* is fixed a support plate 4; 4*a* with a rigid nose 4*a*'. Between the first connecting part 31 of the support means 3 and the nose 4*a*' of the support plate is disposed a hinge means P; P1. Connecting part 31 has two plate-like, elongated parts: the lower connecting part 31*g* and the upper connecting part 31*f* and between said upper connecting part 31*f* and lower connecting part 31*g* is disposed a pneumatic actuator 9. The upper connecting part 31*f* and the lower connecting part 31*g* are connected together from one end that is, for its part, connected horizontally turntable at the top of the hinge means P; P1.

The constructions and the related characteristics of the invention described in a generic way above will be depicted in greater detail below The apparatus of the invention is first generally described.

The figures illustrate one of the most typical support arrangements, which comprises two support modules A and B, which are connected by a part 5, which, beside tractive force, is capable of transmitting especially compression force, and also transverse shearing forces. Of course, there may be more than one of these connecting bars 5, each of them being equipped with means 6 required for optimal lateral adjustment of the support system. The connecting bar 5 above all provides superior reliability regarding the solidity and initial settings and adjustments of the support system compared to armpit supports currently available on the market. In addition, it is capable of efficiently transmitting a lightening and balancing counter-force from the healthy armpit to the support module A of the arm under treatment. All this is achieved by the fact that the connecting rod 5 is capable of transmitting compression and shearing forces beside tractive force, given its rigid or almost rigid manufacture of e.g. aluminium, steel, plastic, compound or similar flat material. It is also obvious that the support system described above is positioned and fixed in the vertical direction also on the patient's back side and over his shoulders, using support straps 23 or braces 21, 22 and 24, for instance.

The support module A of the shoulder under treatment consists of devices, and its initial settings and adjustments, such as angular, longitudinal, lateral and vertical adjustments, can be performed for each patient by a physiotherapist according to the physician's instructions, using precisely these means that can be adjusted and blocked relative to each other. The actual blocking means and devices, such as e.g. parts 8 and P, are easy to use and can be reliably blocked, thus providing reliable and secure initial settings and adjustments as required for the injury to heal.

In the process of the treatment and healing of the injury, independent, active and versatile rehabilitation is accentuated, and this has been rendered easy for the patient to do contrary to these initial settings and adjustments in the support system of the invention as described below.

upper arm rehabilitation movements are allowed for by releasing the blockings and the glide 32, the movements being activated e.g. using finger/palm movements of the same hand by means of e.g. a pressure pump, a connecting hose 9*a* and an actuator 9, thereby also rehabilitating the fingers and the palm. In FIG. 2A, the connecting hose 9*a* has been drawn with a separate broken line for the sake of clarity; however, it may naturally also run "hidden" as an integrated part of the drive power means and the actuator 9 and the parts 10 and 3 between these. In this context, we emphasise that the other movements of the support arrangement can activate these upper arm-rehabilitating movements also internally, such as, for instance:

a turning movement of the arm by means of the device 10 and/or a rotating and/or axial movement of the arm by means of the device 10 and/or by means of the device 4; 4*b*, which is located in the support module B in the healthy armpit.

In addition, the rehabilitating movements can be activated externally, such as, for instance, using the healthy hand or foot/feet, or entirely with the aid of another person or device. Accordingly, in order to rehabilitate the arm, its turning movement can be released by blocking and its rotation and axial movements by blocking. For activating these movements as well, the internal or external coupling means described above can be used.

The armpit support of the healthy arm, support module B, comprises at least the parts 1 and 4 including adjustments, such as e.g. part 4; 4*b* with adjustments 8; 8*a*, and any adjustable supplementary parts may be additionally used. Using this part 4; 4*b*, the patient is able to lighten and balance the armpit support of the arm under treatment with natural use of his healthy hand, and/or he may use the part 4; 4*b* to activate its rehabilitating movements while enhancing his comfort of use.

Besides normal "passive" pads made of foam plastic or the like, the support arrangement of the invention may use pads activated by the patient himself, such as, for instance, depression/overpressure pads 71, 72. Then the patient may himself handily control mainly the surface pressure at critical contact points, in the way he desires, in order to optimise his own comfort of use and treatment.

As shown in the figure, the armpit of the arm under treatment remains very open, allowing the patient to dress and take care of his personal hygiene fairly normally, which, in turn, results in higher comfort of use and easier social life.

Next, we shall discuss in further detail the apparatus of the invention shown at different angles in FIGS. 1A and 1B and the way of fitting the apparatus on the patient (FIGS. 6A and 6B). The module B is intended for attachment to the patient's side, immediately underneath the armpit of the healthy upper limb, the support element 1; 1*b* acting as the frame of the module being located underneath the shoulder joint N. The upper part of the support module B comprises a support plate 4; 4*b* to be fitted in the armpit. The support plate 4; 4*b* of the upper part of the support module B has a size and shape such that the patient is readily allowed to put his hand against his body. A second support plate 4; 4*a* is fixed to the upper part of the support element of the module A, this support plate being fitted in the armpit of the patient's upper limb that has undergone surgery. The support plate 4; 4*a* has the shape of an upwardly turned J, having a size and a radius of curvature of its curved upper part such that said support plate forces the upper arm resting on its upper surface apart from the remaining body. To facilitate attachment, the curvature of the platelike support elements 1 of the modules A and B tallies the curvature of the side of the human body. The support elements of the support modules A and B are connected by a connecting bar 5 to be placed in front of the body. On the other side, a wide band, not shown in FIG. 6, connects the support elements. As mentioned above, the support plate 4; 4*b* has the shape of an upwardly turned J, with the radius of curvature of its curved upper part such that the patient may readily put his hand against his body (FIG. 6A). This support plate has the purpose of acting as a transmission means for the counter-force F1, in order to compensate the force F2 generated by the arm that has been operated on and the weight of the exercising part C acting on this arm. The counter-force F1 is generated as the healthy hand presses the support plate 4; 4*b* downward. A second support plate 4; 4*a* is attached to the upper part of the support element of the module A, this second support plate being fitted in the armpit of the patient's upper limb that has undergone surgery (FIG. 6A). The second support plate 4; 4*a* is under the action of the weight of the arm that has undergone surgery and the parts of the support device attached to this. To facilitate attachment, the curvature of the plate-like support elements 4 of the modules A and B tallies the curvature of the side of the human body (FIG. 6A). The rigid connecting bar 5 used as the connecting piece for connecting the support elements of the support modules A and B on the first side balances the forces F1 and F2 so as to maintain the body in balance. On the other side, a broad band 23 connects the support elements. In addition, a gear and shoulder straps 21, 22, 24 are attached to the module frame 1 for supporting the support modules A and B on the patinet's shoulders and around his neck.

The position between the frame 1 of the two modules A and B and the associated support frame 4 can be altered so that the position of the support plates 4 underneath the patient's shoulder joints N can be adjusted in conformity with the dimensions of the patient's body, the degree of seriousness of the shoulder injury, and the patient's comfort of use. The position of the connecting bar 5 relative to these frames 1 is also adjustable. The facilities for adjusting the mutual position between the support plates 4 and the support elements 1 are illustrated in greater detail in figure 1B.

FIG. 1B illustrates the mechanisms for adjusting the support plate 4; 4*a* on the surgery side; the point of attachment of the frame of the support module A in parallel with the longitudinal axis of the connecting bar is adjusted according to figure 1B by means of control means 6; 6*a*, which is e.g. a clamping screw, whose blocking point in the longitudinal groove of the connecting bar can be varied. The vertical and lateral position of the support plate relative to the plane defined by the connecting bar on the support element, in turn, is adjusted by control means 8 moving in vertical and horizontal grooves, such as clamping screws, in the support element. The control means 8; 8*a* are used to adjust the position of the support plate in the lateral direction, i.e. relative to a vertical plane passing through the longitudinal axis of the connecting bar, in order to fit the support plate at the correct position relative to the side of the patient's body. The control means 8; 8*b* are used for adjusting the upward-downward position of the support plate 4; 4*a* relative to a horizontal plane passing through the connecting bar, and simultaneously the angle of support of the surgery upper limb relative to the longitudinal direction of the body. The mechanisms for adjusting the support plate on the healthy side of the body are the same as the control mechanisms described here, except that vertical adjustments facilities are not indispensable, because the support plate 4; 4*b* is not intended for lifting the patient's healthy arm, but for fitting the support plate in the patient's armpit with the patient's healthy hand pressing the support plate downwards with a suitable force for compensating the weight of the surgery upper limb.

Reverting to FIGS. 1A, 1C and 2A, we note that the exercising module C comprises an upper arm support means 3 and an arm support means 10. The exercising module C is articulated from the connecting part 31 of the support means 3 in the curved upper part in the shape of an upside-down turned J of the support plate 4; 4*a* of the support module 4 (best visible in figure 1C). The point of connection is marked with the letter P. The connecting part turns in the upward-downward direction relative to the support plate at the connecting point, i.e. joint P, so that the plane of the longitudinal axis of the connecting part rotates relative to the plane of the longitudinal axis of the connecting part, in other words, the angle of incidence $\alpha$ between the connecting part and the support plate changes at joint P. Between the lower surface of the connecting part 31 and the upper surface of the support plate 4; 4*a*, there is an actuator 9, by means of which said angle of incidence at the point of connection P is changed (FIG. 1C). The support part 32 of the upper arm support means 3 is associated to the outer end 31*a* of the connecting part 31 relative to the body, the support part consisting in turn of two glide parts in mutually gliding relationship.

The glide parts 32*a* and 32*b* of the support part 32 are disposed to move relative to each other in the longitudinal direction L1 of the support part, this movement being illustrated by FIGS. 4A and 4B. The upper surface of the first broader glide part 32*a* bears against the smooth lower surface of the second narrower support part 32*b*. The upper surface of the second glide part comprises pins 32*c*, between which a narrower glide part 32*b* has been fitted with the longitudinal axes of said glide parts 32 and 32*b* being in alignment. As the angle of the support part formed by the glide parts changes relative to the horizontal plane, the glide parts shift relative to each other and the length L1 of the support part changes from L1; L1' to L; L1".

We revert to figure 1C. Adjustment of the basic position of the support plate 4; 4*a* in the up-down direction is performed with control means 8, as described above. As the connecting part is moved away from the patient's side on the curved portion of the J-shaped support plate, the joint P moves away from the patient's side due to the curvature of the upper part of the support plate. In this manner, one can change the basic angle of incidence between the upper limb and the side prevailing each time. Because the shoulder joint N and the joint P are at different locations, i.e. they are spaced by a given distance L, the length 3 of the upper arm support means necessarily changes as the distance between the shoulder joint and the joint P is altered. The length of the upper arm support means 3 is changed by changing the length of the support part 32 attached to the end of the connecting part 31 articulated at the joint, i.e. point of connection P, and then the upper arm remains supported over its entire length. The change of the length of the support part 32 is illustrated above in connection with FIGS. 4A, 4B and 5. The basic angle of incidence between the body and the upper arm support means 3 is changed when one wishes to change the angle between the upper limb and the body; as post-surgery treatment of the shoulder joint is started, the angle between the upper limb and the body is set so as to be large, and in the process of healing of the shoulder joint, this angle is gradually decreased.

FIG. 7 represents an alternative way for structuring the exercising part C that has been described above in figure 1C. In this time the shape of the support plate 4*a* is about elliptical with a rectangular nose 4*a* ' that connects the support plate 4*a* to the support means 3 via the hinge means P; P1. The nose 4; 4*a* ' is connected to said hinge means P1 by means of a hinge P1 shaft P1*a* that runs through the hole inside the nose 4*a*'. The shaft P1*a* can be rotated axially inside the nose 4*a*'. The lower connecting part 31*g* is supported via a rigid joint member P1*b* on the hinge shaft P1*a* of the hinge P1. Linking lower connecting part and hinge shaft P1*a* is executed in such a way that it will essentially hinder mutual movements of these parts in vertical direction. The upper connecting part 31*f* joints to the lower connecting part 31*f* with a fork-like hinge P1*c*, that will allow mutual movements of these parts 31*f*,31*g* in vertical direction, but not in lateral direction. The hinge P1 is connected to the hinge shaft P1*a* vertically pivotable via a mortise joint while its lateral movements in relation to the hinge shaft P1 are hindered. Between the upper connecting part 31*f* and lower connecting part 31*g* is disposed a pneumatic actuator 9 that will change the angle of incidence between mentioned connecting parts 31*f* and 31*g* of the support means 3 by forcing a gap to be opened between said parts 31*f* and 31*g* (Of course the upper part 3*f* of the upper arm support means 3 is also rotated relative to the support plate 4; 4*a* while using the actuator 9, since the support plate 4 is fixed essentially stationary to the hinge means P; P1). The upper limb resting on the surface of the upper part 31*f* will be raised. In this application mode an upper arm will rest on the upper part of the connecting means 31; 31*a* and will be exercised in up and down direction by changing the angle of incidence between connecting parts 31*g* and 31*f* by actuator 9. Additionally, the hinge shaft P1*a* inside the hinge P1 can be rotated in relation to its longitudinal axis. Since the angle of incidence between upper part 31*f* and the lower part 31*g* remains simultaneously constant, the first connecting part 31 of the support means will draw a certain angle in a certain level around the axis of the shaft P1*a* of the hinge means P1. We can also say that the certain point of the connecting part 31 draws an angle in a certain vertical level in horizontal or nearly horizontal plane. When the shaft P1*a* is rotated inside the hinge P1, the arm resting on the upper part 31*f* of the support means 3 will rotate correspondingly around the (longitudinal) axis of the shaft P1. This rotational movement of the hinge shaft P1 will allow an additionally exercising possibility: one can move upper limb back and forth in relation to the shoulder line and in this way to exercise muscle groups moving upper limb on certain horizontal plane.

FIG. 5 shows how the glide parts 32*a* and 32*b* move relative to each other when the angle of the plane passing through the support part 32 to the horizontal plane is changed. A change of the basic angle of incidence between the support plate and the connecting means has been described above, and at the same time the length of the support part of the upper arm requires a change. In FIG. 5, the pneumatic actuator 9 at the basic angle of incidence, i.e. 0 angle, does not lift the support means, but the support means 3 bears against the curved surface of the support plate 4. As the upper arm is exercised, the length of the support part 32 is changed. FIG. 5 shows how the upper arm is exercised with the aid of the exercising part; the actuator 9, such as a pneumatic cylinder (or air cushion as in FIG. 3), bears against the upper surface of the support plate 4; 4*a*, pushing the connecting part 31 of the support means away from the plane of the support plate 4; 4*a*, the connecting part 31 swivelling around the joint P and a given angle αbeing formed between the support plate and the connecting part. The actuator 9 is driven with an air pump kept in the hand of the patient's surgery upper limb, from where an air hose 9*a* leads to the actuator 9 (shown in FIG. 2A). Because the support means 3 is moved relative to the shoulder joint, the length L1 of the support part 32 necessarily increases from the initial length L', first to the length L", as the angle grows to 40 degrees, and further to the length L" as the angle increases to 90 degrees, because the support means joint P is not at the same location as the shoulder joint, but at the point of connection P between the support plate 4*a* and the connecting part 31 of the support means 3. As the upper arm is moved with the mechanism shown in FIG. 5, the muscles of the shoulder joint do not work, but still the upper limb gets the exercise it needs, speeding up healing of the upper arm and the shoulder joint after surgery.

FIG. 3 illustrates still another way of transferring the point of connection P between the support plate 4; 4*a* and the connecting part 31 of the upper arm support means 3 on said support plate, when it is desirable to change the basic angle of incidence between the upper limb and the body in the process of healing. The surface of the support plate 4; 4*a* has a groove 32 with fixing pins 31 at its edges. A pneumatic actuator, such as an air cushion 9, is disposed in the groove 32 so as to be movable in either direction in the groove. The point of connection P, marked with a broken line, between the connecting part 3; 31 of the support means and the support plate can be changed by shifting the fixing point of the connecting part from one pair of fixing pins to another, while the distance of the connecting point P to the shoulder joint changes. As the distance between the connecting point P and the shoulder joint changes, the total length of the glide parts of the upper arm support part also changes, resulting in the upper arm being consistently supported over its entire length (cf. FIG. 5). As the treatment proceeds, the angle of incidence between the body and the upper limb can be diminished while also diminishing the angle of incidence between the body and the upper arm support means, because the upper limb is supported by said support means 3.

The main components of the apparatus of FIGS. 1A and 2A and the operation of these components have been described above. Said apparatus also comprises other parts of less relevance for the implementation of the invention: an arm support means 10 is articulated at the end of the upper arm support means. The arm support means and the upper arm support means comprise among other things various pads 71, 72 and fixing and support means 101, by means of which the arm is solidly and flexibly attached to said support means. The hand-operated air pump actuating the actuator is located on the support means 101, from where an air hose 9*a* leads to the actuator.

The entire apparatus of the invention is fixed in the immediate vicinity of the shoulder joints so as not to hamper the patient's movements and sleep significantly, contrary to known apparatuses proposed for a similar purpose, which get their support from the hip.

Only a number of embodiments of the invention have been described above, and it is obvious to those skilled in the art that the invention can be implemented in many other ways without departing from the scope of protection of the claims. Thus, the connecting bar 5 may consist of several parts, the actuator 9 may be either an air cushion, a pneumatic cylinder, however, other manually operated actuators can also be used. The actuator 9 can, for example, be a pressure spring, that is advantageously provided with a removable stopper that will prevent the operation of this spring while resting. When the stopper is removed, the spring will be opened, which will force the upper part 31*f* to rotate around the fork-like joint body P1*c* in vertical direction. A gap will be opened between the upper part 31*f* and the lower part 31*f* and the upper limb resting on the surface of the upper part 31*f* will be raised. By pushing the upper part with upper limb against the spring force generated by the pressure spring one can exercise muscles that moves upper limb up and down. The support part 32 may consist of two or more parts and it may be equipped with a different mechanism than the one described in the embodiment example above.

The invention claimed is:

1. An apparatus for exercising and supporting an upper limb, the apparatus comprising two support modules (A, B) connected on the first side by a rigid connecting piece (5), wherein:

both the support modules (A, B) have a frame (1), with a support plate (4) fixed to its upper part, an exercising part (C) is removably attached to the support plate (4) of the first support module (A), the exercising part ( C ) comprises an upper arm support means (3) articulated or hinged in the support plate (4; 4*a*) and an actuator (9) rotating or moving said support means (3) or part of it relative to the support plate (4; 4*a*), wherein the exercising part (C) comprises an upper arm support means (3) and an arm support means (10), the upper arm support means (3) comprising a connecting part (31), which is articulated in a curved support plate (4; 4*a*) at a point of connection (P), and a pneumatic actuator (9) being disposed between said connecting part (31) and said curved support plate (4; 4*a*).

2. An apparatus as defined in claim 1, wherein the upper arm support means (3) additionally comprises an upper arm support part (32), which is articulated at the end of the connecting part (31) and whose length (L1) is variable.

3. An apparatus as defined in claim 2, wherein the length (L1) of the upper arm support part (32) is changed with two or more glide parts (32*a*, 32*b*) fixed in gliding relationship.

4. An apparatus as defined in claim 3, wherein the overall length (L1) of the glide parts (32, 32*b*) depends on the angle of incidence (α) between the connecting means (31) of the upper arm shoulder means (3) and the support plate (4; 4*a*).

5. An apparatus as defined in claim 4, wherein an arm support means (10) is rotationally fixed at the end of the upper arm support part (32).

6. An apparatus as defined in claim 3, wherein an arm support means (10) is rotationally fixed at the end of the upper arm support part (32).

7. An apparatus as defined in claim 2, wherein an arm support means (10) is rotationally fixed at the end of the upper arm support part (32).

8. An apparatus as defined in claim 1, wherein the distance between the shoulder joint (N) and the point of connection (P) between the connecting part (31) and the support plate (4) can be altered.

9. An apparatus as defined in claim 1, wherein the support means (3) or part thereof is hinged or articulated to the curved support plate (4) and can be turned essentially horizontally or vertically in relation to the support plate (4).

10. An apparatus as defined in claim 9, wherein the connecting part (31) is hinged horizontally turntable to the nose (4*a*') of the support plane (4).

11. An apparatus for exercising and supporting an upper limb, the apparatus comprising two support modules (A, B) connected on the first side by a rigid connecting piece (5), wherein:

both the support modules (A, B) have a frame (1), with a support plate (4) fixed to its upper part, an exercising part (C) is removably attached to the support plate (4) of the first support module (A), the exercising part (C) comprises an upper arm support means (3) articulated or hinged in the support plate (4; 4*a*) and an actuator (9) rotating or moving said support means (3) or part of it relative to the support plate (4; 4*a*), wherein the exercising part (C) comprises an upper arm support means (3) comprising a connecting part (31) comprising an upper connecting part (31*f*) and a lower connecting part (31*g*), which parts (31*f*, 31*g*) are hinged in a support plate (4; 4*a*) by means of a hinge means (P; P1), and a pneumatic actuator (9) being disposed between said lower and upper connecting parts (31*g*, 31*f*).

12. An apparatus as defined in claim 11, wherein the upper arm support means (3) additionally comprises an upper arm support part (32), which is articulated at the end of the connecting part (31) and whose length (L1) is variable.

13. An apparatus for exercising and supporting an upper limb, the apparatus comprising two support modules (A, B) connected on the first side by a rigid connecting piece (5), wherein:

both the support modules (A, B) have a frame (1), with a support plate (4) fixed to its upper part, an exercising part (C) is removably attached to the support plate (4) of the first support module (A), the exercising part ( C ) comprises an upper arm support means (3) articulated or hinged in the support plate (4; 4*a*) and an actuator (9) rotating or moving said support means (3) or part of it relative to the support plate (4; 4*a*), wherein the support means (3) comprises first connecting means (31) composing of upper connecting part (31*f*) and lower connecting part (31*g*) and between these connecting parts (31*f*, 31*g*) being disposed a actuator (9) that can be actuated to change the angle of incidence between said connecting parts (31*f*, 31*g*) and also the angle of incidence between the upper connecting part (31*f*) and the support plate (4).

14. An apparatus as defined in claim 13, wherein the actuator (9) is a pressure spring or a pneumatic device.

* * * * *